US005950919A

United States Patent [19]

Adams

[11] Patent Number: 5,950,919

[45] Date of Patent: Sep. 14, 1999

[54] REMOTE MAIL DELIVERY INDICATOR SYSTEM

[76] Inventor: Melvin Adams, 658 Lawton St., Atlanta, Ga. 30310

[21] Appl. No.: 08/988,650

[22] Filed: Dec. 11, 1997

[51] Int. Cl.[6] ..... B65D 91/00

[52] U.S. Cl. ..... 232/34; 232/17; 340/569

[58] Field of Search ..... 232/17, 34, 35, 232/36, 37; 340/568, 569, 570

[56] References Cited

U.S. PATENT DOCUMENTS

| | | | |
|---|---|---|---|
| 1,758,546 | 5/1930 | Wartmann . | |
| 2,835,887 | 5/1958 | Seeley et al. . | |
| 3,556,394 | 1/1971 | Caldes | 232/36 |
| 3,611,333 | 10/1971 | Conigliaro . | |
| 4,089,460 | 5/1978 | Mellard | 232/34 |
| 4,262,839 | 4/1981 | Wisniewski . | |
| 4,651,135 | 3/1987 | Duhaime et al. | 232/34 X |
| 5,125,570 | 6/1992 | Jones | 232/34 |
| 5,247,282 | 9/1993 | Marshall | 232/35 X |
| 5,335,848 | 8/1994 | Schreiber | 232/34 |
| 5,664,728 | 9/1997 | Jones | 232/36 |

*Primary Examiner*—Terry Lee Melius
*Assistant Examiner*—William L. Miller

[57] ABSTRACT

A new remote mail delivery indicator system for signaling to the user when the mail is delivered by utilizing an led display or speaker producing a distinct intermittent sound. The remote mail delivery indicator system includes a pressure sensitive transmitter positioned on the cornice of the floor of a mailbox, whereby when mail is inserted the mailbox the pressure sensitive transmitter transmits a signal which is detected by an electronic receiver which signals the user.

9 Claims, 3 Drawing Sheets

REMOTE MAIL DELIVERY INDICATOR SYSTEM

BACKGROUND OF THE INVENTION

1. Field of the Invention

The present invention relates to Mailbox Devices and more particularly pertains to a new Remote Mail Delivery Indicator System for signaling to the user when the mail is delivered by utilizing an led display or speaker producing a distinct intermittent sound.

2. Description of the Prior Art

The use of Mailbox Devices is known in the prior art. More specifically, Mailbox Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Mailbox Devices include U.S. Pat. No. 5,273,207; U.S. Pat. No. 5,247,282; U.S. Pat. No. 4,101,877; U.S. Pat. No. 5,123,590; U.S. Pat. No. 4,999,612 and U.S. Pat. No. 4,262,839.

While these devices fulfill their respective, particular objectives and requirements, the aforementioned patents do not disclose a new Remote Mail Delivery Indicator System. The inventive device includes a pressure sensitive transmitting means positioned on the cornice of the floor of a mailbox, whereby when mail is inserted the mailbox the pressure sensitive transmitting means transmits a signal which is detected by an electronic receiver which signals the user.

In these respects, the Remote Mail Delivery Indicator System according to the present invention substantially departs from the conventional concepts and designs of the prior art, and in so doing provides an apparatus primarily developed for the purpose of signaling to the user when the mail is delivered by utilizing an led display or speaker producing a distinct intermittent sound.

SUMMARY OF THE INVENTION

In view of the foregoing disadvantages inherent in the known types of Mailbox Devices now present in the prior art, the present invention provides a new Remote Mail Delivery Indicator System construction wherein the same can be utilized for signaling to the user when the mail is delivered by utilizing an led display or speaker producing a distinct intermittent sound.

The general purpose of the present invention, which will be described subsequently in greater detail, is to provide a new Remote Mail Delivery Indicator System apparatus and method which has many of the advantages of the Mailbox Devices mentioned heretofore and many novel features that result in a new Remote Mail Delivery Indicator System which is not anticipated, rendered obvious, suggested, or even implied by any of the prior art Mailbox Devices, either alone or in any combination thereof.

To attain this, the present invention generally comprises a pressure sensitive transmitting means positioned on the cornice of the floor of a mailbox, whereby when mail is inserted the mailbox the pressure sensitive transmitting means transmits a signal which is detected by an electronic receiver which signals the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Remote Mail Delivery Indicator System apparatus and method which has many of the advantages of the Mailbox Devices mentioned heretofore and many novel features that result in a new Remote Mail Delivery Indicator System which is not anticipated, rendered obvious, suggested, or even implied by any of the prior art Mailbox Devices, either alone or in any combination thereof.

It is another object of the present invention to provide a new Remote Mail Delivery Indicator System which may be easily and efficiently manufactured and marketed.

It is a further object of the present invention to provide a new Remote Mail Delivery Indicator System which is of a durable and reliable construction.

An even further object of the present invention is to provide a new Remote Mail Delivery Indicator System which is susceptible of a low cost of manufacture with regard to both materials and labor, and which accordingly is then susceptible of low prices of sale to the consuming public, thereby making such Remote Mail Delivery Indicator System economically available to the buying public.

Still yet another object of the present invention is to provide a new Remote Mail Delivery Indicator System which provides in the apparatuses and methods of the prior art some of the advantages thereof, while simultaneously overcoming some of the disadvantages normally associated therewith.

Still another object of the present invention is to provide a new Remote Mail Delivery Indicator System for signaling to the user when the mail is delivered by utilizing an led display or speaker producing a distinct intermittent sound.

Yet another object of the present invention is to provide a new Remote Mail Delivery Indicator System which includes a pressure sensitive transmitting means positioned on the cornice of the floor of a mailbox, whereby when mail is inserted the mailbox the pressure sensitive transmitting means transmits a signal which is detected by an electronic receiver which signals the user.

Still yet another object of the present invention is to provide a new Remote Mail Delivery Indicator System that notifies the user when mail is delivered where the mailbox is a substantial distance away from the dwelling.

Even still another object of the present invention is to provide a new Remote Mail Delivery Indicator System that lets the user know when or if the mail has been delivered.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
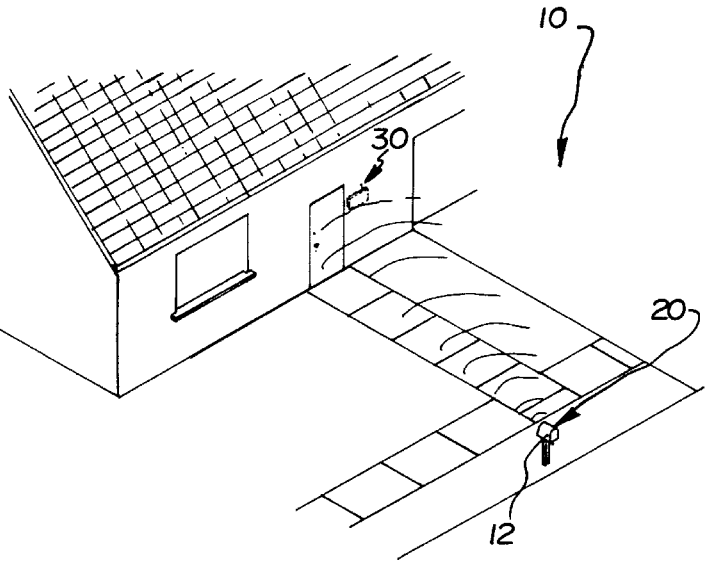
FIG. 1 is a side perspective view of a new Remote Mail Delivery Indicator System according to the present invention.
Figure 2:
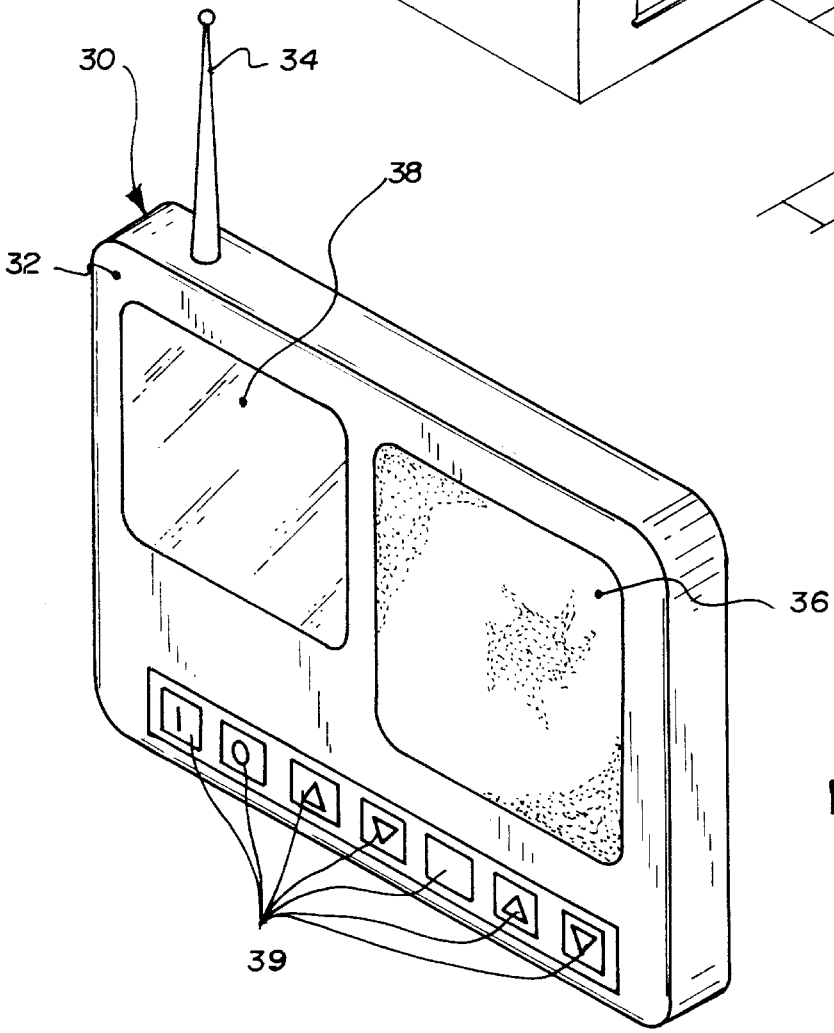
FIG. 2 is a magnified side perspective view of a receiver means.

With reference now to the drawings, and in particular to FIGS. 1 through 6 thereof, a new Remote Mail Delivery Indicator System embodying the principles and concepts of the present invention and generally designated by the reference numeral 10 will be described.

More specifically, it will be noted that the Remote Mail Delivery Indicator System 10 comprises a pressure sensitive transmitting means 20 which is portable and transmits a signal when mail is inserted into a mailbox structure 12, and a receiver means 30 detecting the signal and thereafter informing a user that the mail has been delivered.

Figure 3:
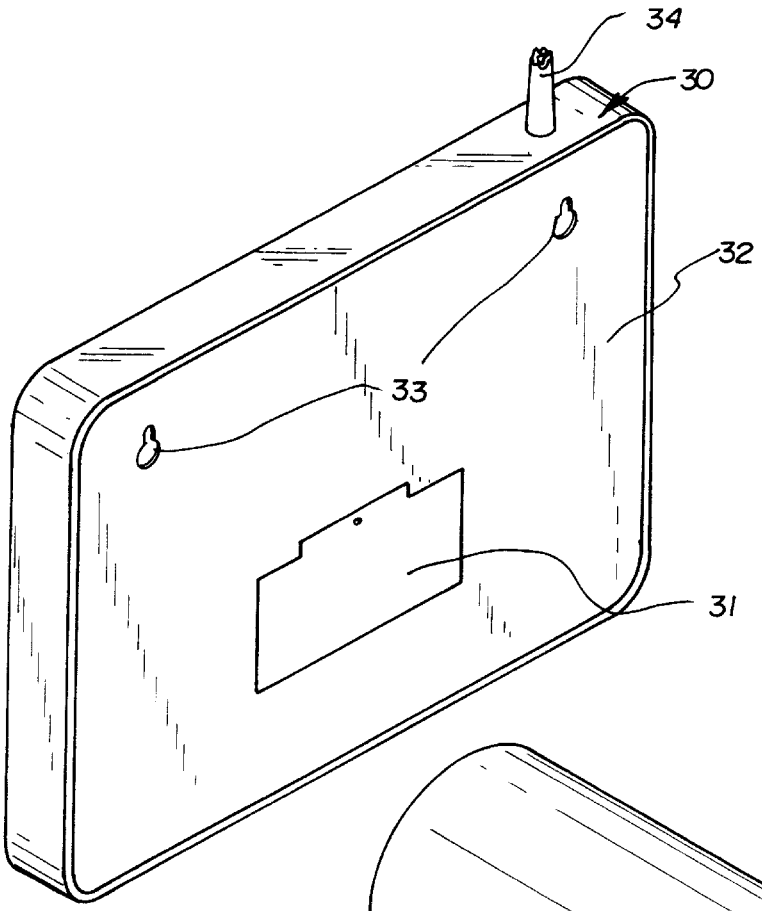
FIG. 3 is a rear view of the receiver means disclosing the mounting means.
Figure 4:
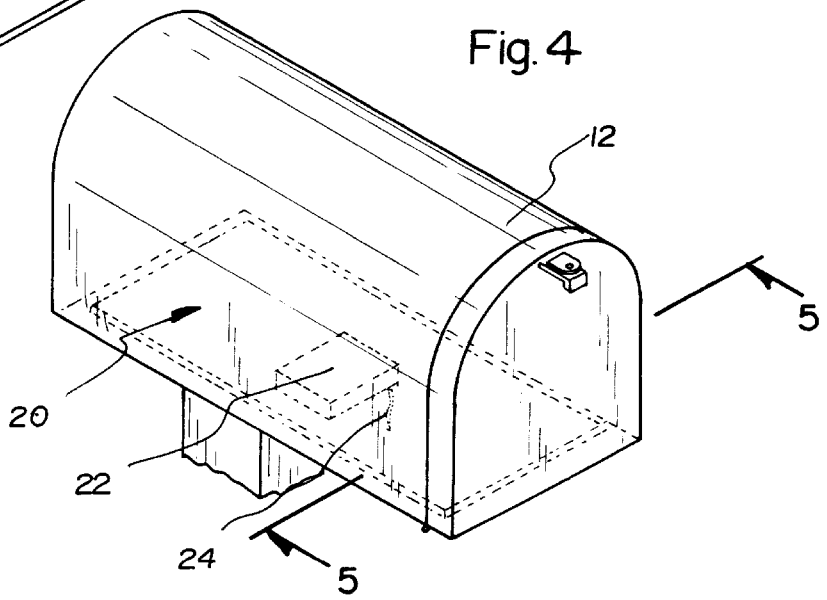
FIG. 4 is a side perspective view of the electronic transmitter within the mailbox.
Figure 5:
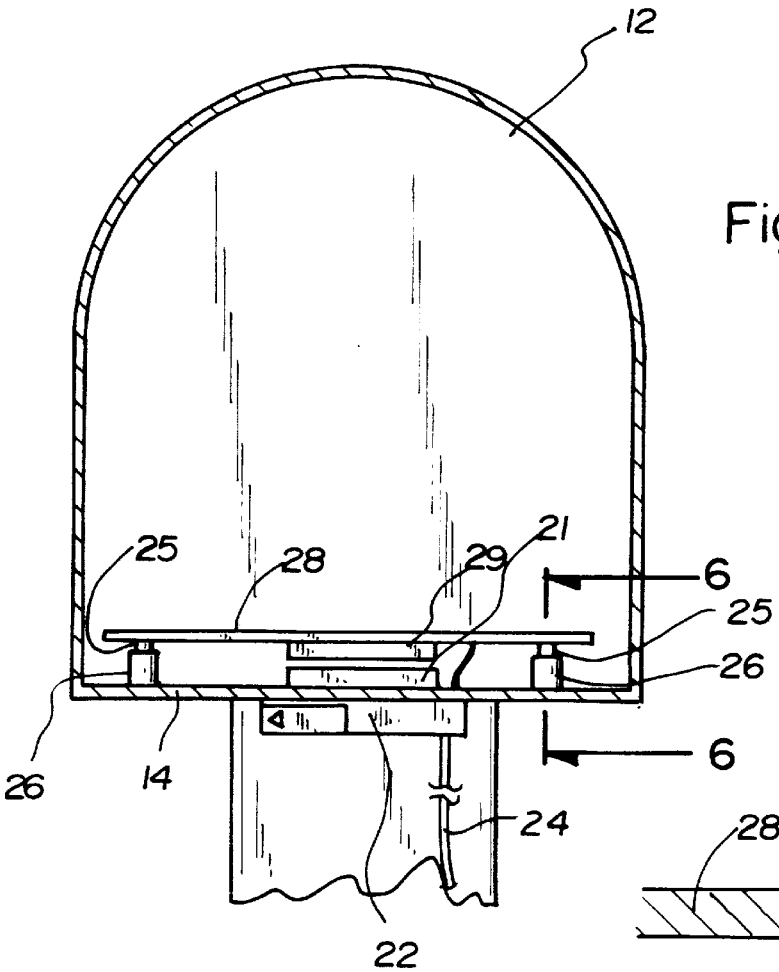
FIG. 5 is a cross sectional view taken along line 5—5 of FIG. 4 disclosing the receiver means.
Figure 6:
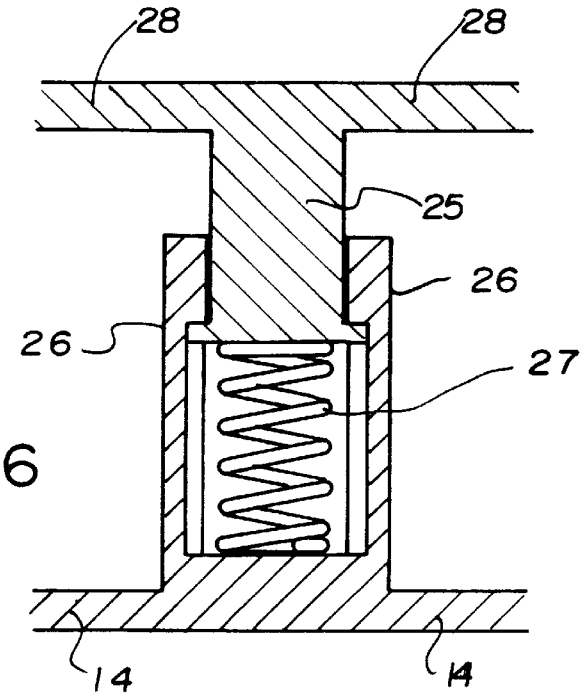
FIG. 6 is a cross sectional view taken along line 6—6 of FIG. 5 displaying the tubular member encasing the compression spring.

As best illustrated in FIGS. 1 through 6, it can be shown that the pressure sensitive transmitting means 20 includes at least one tubular member 26 with one end secured to a cornice of a mailbox floor 14 projecting orthogonally to the cornice. A compression spring 27 is freely positioned within each tubular member 26 with one end engaging the cornice of the mailbox floor 14. A support shaft 25 slidably projects into the tubular member 26 opposite of the cornice and engaging the compression spring 27. A planar plate 28 is shaped to the form of the cornice of the mailbox floor as best disclosed in FIG. 4 of the drawings. The bottom surface of the planar plate 28 orthogonally secures the support shafts 25 at the end opposite of the compression spring 27 as shown in FIGS. 5–6. An electronic transmitter 22 is secured on the bottom surface of the mailbox floor 14 including a transmitting antenna 24 electronically connected to said electronic transmitter 22 for transmitting a signal when activated. A first magnetic contact 29 secured to the bottom surface of the planar plate 28 and is electronically connected to the electronic transmitter 22. A second magnetic contact 29 is secured to the cornice of the mailbox floor 14 in aposition to the first magnetic contact 29. As shown in FIG. 5 of the drawings, the magnetic contacts 29 are spaced a finite distance apart allowing vertical movement of the planar plate 28. The receiver means 30 includes a housing 32. A portable power supply 31 is positioned within the housing 32. A mounting means 33 is attached to the rear exterior surface of the housing 32 for mounting as shown in FIG. 3 of the drawings. An unnumbered electronic receiver is positioned within the housing 32 and electronically connected to the portable power supply 31. The unnumbered electronic receiver detects the signal produced from the electronic transmitter 22. A receiving antenna 34 is secured to the exterior surface of the housing 32 and electronically connected to the unnumbered electronic receiver. A speaker 36 is electronically connected to the unnumbered electronic receiver producing an intermittent audible sound. An LED display 38 is electronically connected to the unnumbered electronic receiver. A plurality of control buttons 39 are electronically connected to the unnumbered electronic receiver. The components are preferably constructed from weather resistant materials.

In use, when mail is inserted into the mailbox structure 12, the weight of the mail forces the planar plate 28 to descend, compressing the compression springs 27 within the tubular members 26. The first and second magnetic contacts 29, 21 become juxtaposed which closes a circuit within the second magnetic contact 21. The closed circuit allows the electronic transmitter 22 to transmit a signal which is detected by the unnumbered electronic receiver. The unnumbered electronic receiver thereafter sends an electronic signal to the speaker 36 and/or the LED display 38, thereby informing the user that the mail has been delivered.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remote mail delivery indicator system includes:

a mailbox having an interior and a floor with an upper surface;

a pressure sensitive transmitting means which is portable and transmits a signal when mail is inserted into the interior of the mailbox;

a receiver means detecting the signal and thereafter informing a user that the mail has been delivered;

wherein the pressure sensitive transmitting means includes at least one tubular member having an end secured to the upper surface of the mailbox floor, the tubular member being positioned orthogonally to the upper surface of the mailbox floor;

a compression spring positioned in the tubular member with a first end of the compression spring engaging the upper surface of the mailbox floor;

a support shaft slidably projecting into the tubular member for engaging a second end of the compression spring;

a planar plate having a shape generally corresponding to the shape of the upper surface of the mailbox floor, wherein a bottom surface of the planar plate is secured to the support shaft;

an electronic transmitter secured on the mailbox floor, the electronic transmitter including a transmitting antenna electronically connected to said electronic transmitter for transmitting a signal when activated; and a first magnetic contact secured to the bottom surface of the planar plate, the first magnetic contact being electronically connected to the electronic transmitter, and a second magnetic contact secured to the upper surface of the mailbox floor in opposition to the first magnetic contact, wherein said magnetic contacts are spaced a finite distance apart for allowing vertical movement of the planar plate.

2. The remote mail delivery indicator system of claim 1, wherein the receiver means includes:

a housing;

a portable power supply positioned in the housing;

a mounting means attached to an exterior surface of the housing for mounting the housing to a surface;

an electronic receiver positioned in the housing, the electronic receiver being electronically connected to the portable power supply, wherein the electronic receiver is adapted to detect the signal produced by the electronic transmitter;

a receiving antenna secured to the housing, the receiving antenna being electronically connected to the electronic receiver;

a speaker electronically connected to the electronic receiver and being for producing an intermittent audible sound;

an LED display electronically connected to the electronic receiver; and a plurality of control buttons electronically connected to the electronic receiver.

3. The remote mail delivery indicator system of claim 2, wherein the housing is constructed from weather resistant materials.

4. A remote mail delivery indicator for use with a mailbox having an interior and a floor with an upper surface, the remote mail delivery indicator comprising:

a pressure sensitive transmitting means adapted for transmitting a signal when mail is inserted into the mailbox;

the pressure sensitive transmitting means includes a planar plate and a plurality of support shafts, the support shafts being secured to a lower surface of the planar plate in a substantially orthogonal relationship to the lower surface, each of the support shafts being for engaging a compression spring; and a receiver means detecting the signal and thereafter informing a user that the mail has been delivered;

wherein the pressure sensitive transmitting means includes:

at least one tubular member with one end adapted for being secured to the upper surface of the mailbox floor;

the compression spring being positioned in the tubular member with a first end of the compression spring being adapted for engaging the upper surface of the mailbox floor;

the support shaft slidably being for projecting into the tubular member for engaging a second end of the compression spring;

an electronic transmitter adapted for securing to a bottom surface of the mailbox floor, the electronic transmitter including a transmitting antenna electronically connected to said electronic transmitter for transmitting a signal when activated; and a first magnetic contact secured to the bottom surface of the planar plate, the first magnetic contact being electronically connected to the electronic transmitter, and a second magnetic contact adapted for securing to the upper surface of the mailbox floor in opposition to the first magnetic contact, wherein said magnetic contacts are spaced a finite distance apart allowing vertical movement of the planar plate.

5. The remote mail delivery indicator system of claim 4, wherein the receiver means includes:

a housing;

a portable power supply positioned within the housing;

a mounting means attached to an exterior surface of the housing for mounting the housing to a surface;

an electronic receiver positioned in the housing the electronic receiver being electronically connected to the portable power supply, wherein the electronic receiver is adapted to detect the signal produced by the electronic transmitter;

a receiving antenna secured to the housing, the receiving antenna being electronically connected to the electronic receiver;

a speaker electronically connected to the electronic receiver and being for producing an intermittent audible sound;

an LED display electronically connected to the electronic receiver; and a plurality of control buttons electronically connected to the electronic receiver.

6. The remote mail delivery indicator system of claim 5, wherein the housing is constructed from weather resistant materials.

7. A remote mail delivery indicator system includes:

a mailbox having an interior and a floor with an upper surface;

a pressure sensitive transmitting means which is portable and transmits a signal when mail is inserted into the interior of the mailbox;

a receiver means being for detecting the signal and thereafter informing a user that the mail has been delivered;

wherein the pressure sensitive transmitting means includes at least one tubular member having an end secured to the upper surface of the mailbox floor, the tubular member being positioned orthogonally to the upper surface;

a compression spring being positioned in the tubular member with a first end of the compression spring engaging the upper surface;

a support shaft slidably projecting into the tubular member for engaging a second end of the compression spring;

a planar plate having a shape generally corresponding to the shape of the upper surface of the mailbox floor, wherein the support shaft is secured to a bottom surface of the planar plate in a substantially orthogonal relationship;

an electronic transmitter secured on the bottom surface of the mailbox floor, the electronic transmitter including a transmitting antenna electronically connected to said electronic transmitter for transmitting a signal when activated; and a first magnetic contact secured to the bottom surface of the planar plate, the first magnetic contact being electronically connected to the electronic transmitter and a second magnetic contact secured to the upper surface of the mailbox floor in opposition to the first magnetic contact, wherein said magnetic contacts are spaced a finite distance apart for allowing vertical movement of the planar plate.

8. The remote mail delivery indicator system of claim 7, wherein the receiver means includes:

a housing;

a portable power supply positioned in the housing;

a mounting means attached to an exterior surface of the housing for mounting for housing to a surface;

an electronic receiver positioned in the housing the electronic receiver being electronically connected to the portable power supply, wherein the electronic receiver is adapted to detect the signal produced by the electronic transmitter;

a receiving antenna secured to the housing, the receiving antenna being electronically connected to the electronic receiver;

a speaker electronically connected to the electronic receiver and being for producing an intermittent audible sound;

an LED display electronically connected to the electronic receiver; and a plurality of control buttons electronically connected to the electronic receiver.

9. The remote mail delivery indicator system of claim 8, wherein the housing is constructed from weather resistant materials.

* * * * *